US006066924A

United States Patent [19]

Lederer

[11] Patent Number: 6,066,924

[45] Date of Patent: May 23, 2000

[54] CANDLE EMULATION

[76] Inventor: Gabor Lederer, 28 Summit Ave., Hackensack, N.J. 07601

[21] Appl. No.: 09/082,875

[22] Filed: May 21, 1998

[51] Int. Cl.[7] ..... H05B 37/00

[52] U.S. Cl. ..... 315/185 R; 315/185 S; 315/209 R; 315/307; 362/810; 362/392

[58] Field of Search ..... 315/185 R, 185 S, 315/209 R, 294, 307, 315, 362; 362/810, 186, 184, 202, 806, 392, 192; 331/111

[56] References Cited

U.S. PATENT DOCUMENTS

| | | | |
|---|---|---|---|
| 3,890,085 | 6/1975 | Andeweg | 431/125 |
| 3,893,041 | 7/1975 | Foster et al. | 331/45 |
| 4,550,363 | 10/1985 | Sandell | 362/351 |
| 4,675,578 | 6/1987 | Mitchell et al. | 315/315 |
| 5,863,108 | 1/1999 | Lederer | 362/186 |

*Primary Examiner*—Haissa Philogene
*Attorney, Agent, or Firm*—Israel Nissenbaum

[57] ABSTRACT

A wax candle simulation device with random flicker electric circuitry, comprising at least two miniature light bulbs mechanically vertically closely arranged with the filaments therein arranged at an angle. The bulbs are contained within a flame shaped translucent housing and are connected to an electrical circuitry comprising two transistors, with one driving the other (inverter) with an external control and a switch between them set by resistor values. Additional resistors slow down light bulb shut down and the filaments are constantly pre-heated with a slow cool down, whereby the transition between the lighting of the light bulbs is very gradual. A single counter IC, creates the external driver circuitry with a portion of the IC providing a low stability oscillator and another portion operating as a counter with outputs connected to resistors. The other ends of the resistors are parallel and connected to the inverter. A random selector depends on the counter with the parallel original value of the resistors deciding the start of the inverter, which also depends on value selection, oscillator stability and the number of outputs used. This creates a variety of values which will repeat only several minutes later if the oscillator is stable at the time. The components have low tolerances whereby there are no two candle emulations of the same pattern.

3 Claims, 1 Drawing Sheet

CANDLE EMULATION

FIELD OF THE INVENTION

This invention relates to devices which emulate the appearance of candles contained within decorative holders and particularly with respect to candle emulations used in place of wax votive candles used in churches and intimate lighting and decorative candle fixtures often used in restaurants.

BACKGROUND OF THE INVENTION

Wax candles with actual flames are often used for decorative or religious purposes. Decorative uses include subdued lighting in restaurants and religious uses of candles includes votive candles. In addition to the extra cost of wax candles, candles with open flames, particularly if used in large multiples, pose risk of fire. Accordingly, it is desirable that the wax flame candle be replaced by electrical candle simulations. However the use of such simulations, if not accurate or realistic, leaves an undesirable impression of cheapness in restaurants and a feeling of digression from tradition in churches. Current electrical candle emulation devices with electric light bulbs are readily discernible as being artificial and do not realistically imitate the smoothing swirling effect of a real candle and flame. While a candle flame is totally random in terms of flicker movement and configuration, an electric candle emulation often goes through a pre-set number of filament lightings and this is overtly repeated time after time after time over apparent short time intervals. A viewer can thus readily discern the electrical nature of the lighting.

SUMMARY OF THE INVENTION

It is therefore an object of the present invention to provide a realistic looking candle emulation with a random flicker pattern.

It is a further object of the present invention to provide the candle emulation by means of multiple miniature lamps closely arranged with each other whereby the respective lighting filaments are at an angle such that non-repeatable flicker variations are possible.

It is another object of the present invention to provide a circuit with random counter and random output of lighting intensity and filament lighting activation and deactivation to provide the realistic candle emulation.

It is still another object of the present invention to specifically utilize inexpensive components having low tolerances to further enhance the randomness of candle lighting or flicker, resulting from reduced replication.

Generally the present invention comprises a realistic wax candle emulation device comprising at least two miniature light bulbs fixedly vertically arranged in a translucent housing therefor preferably with housing having a flame configuration. The filaments of the bulbs are offset from each other whereby they form an angle and preferably a 90° angle. The light bulbs are connected to random flicker circuitry means whereby the filaments are randomly and slowly lit (to avoid abrupt and too sharply defined filament light switchover) in a random pattern to more realistically emulate the illumination of a wax candle light.

These and other objects, features and advantages of the present invention will become more evident from the following discussions and drawings in which:

SHORT DESCRIPTION OF THE DRAWINGS

FIG. 1 is a schematic of the circuitry used in accordance with the present invention; and FIG. 2 is partially sectioned view of a "candle" of the present invention showing the bulbs contained therein, and in juxtaposition with a charging unit for the recharging of internally contained battery elements and a prong switch element.

DETAILED DESCRIPTION OF THE INVENTION

In a preferred embodiment of the present invention, the random flicker circuitry comprises two transistors, with one driving the other, i.e., inverter, with an external control and a switch between them set by resistor values. Additional resistors slow down light bulb shut down whereby the filaments are constantly pre-heated with a slow cool down. As a result, the transition between the lighting of the light bulbs is very gradual. The circuit further comprises a single counter IC, which creates the external driver circuitry with a portion of the IC providing a low stability oscillator and another portion operating as a counter with outputs connected to resistors. The other ends of the resistors are parallel and connected to the inverter. A random selector depends on the counter with the parallel original value of the resistors deciding the start of the inverter, which also depends on value selection, oscillator stability and the number of outputs used. This creates a variety of values which will repeat only several minutes later if the oscillator is stable at the time. The components are selected to have low tolerances whereby there are no two candle emulations of the same pattern.

In a preferred physical embodiment the aforementioned circuitry and a rechargeable battery are contained within a flat cylindrical white plastic container of a size and shape similar to common flat candles normally utilized in cut glass decorative holders. An upper portion of the "candle" cylinder is provided with a nipple protrusion sufficient to contain the bulb pair therein. For convenience and aesthetics the bottom of the "candle" is provided with a socket for insertion of a prong recharging element. The prong serves the dual purpose of accessing the recharging element of the internal battery and also serves to close an internal switch to keep the "candle" from being lit. A separate prong element can be used for insertion into the socket to maintain the candle in a non-lit mode until the prong is removed. In appearance, except for a nipple instead of a wick, the "candle" of the present invention closely resembles a common flat cylindrical candle. To complete the appearance, the "candle" of the present invention is placed into a cut glass bowl, usually of a decorative color, wherein the illusion of an actual candle is complete, absent an actual direct viewing of the candle top. The translucent casing for the closely spaced bulbs effects a realistic diffusion of light with a flickering glowing effect without sharp light spots directly from the filaments. The battery should be sufficient to provide at least several hours of "candle" light.

DETAILED DESCRIPTION OF THE DRAWINGS AND THE PREFERRED EMBODIMENT

Figure 1:
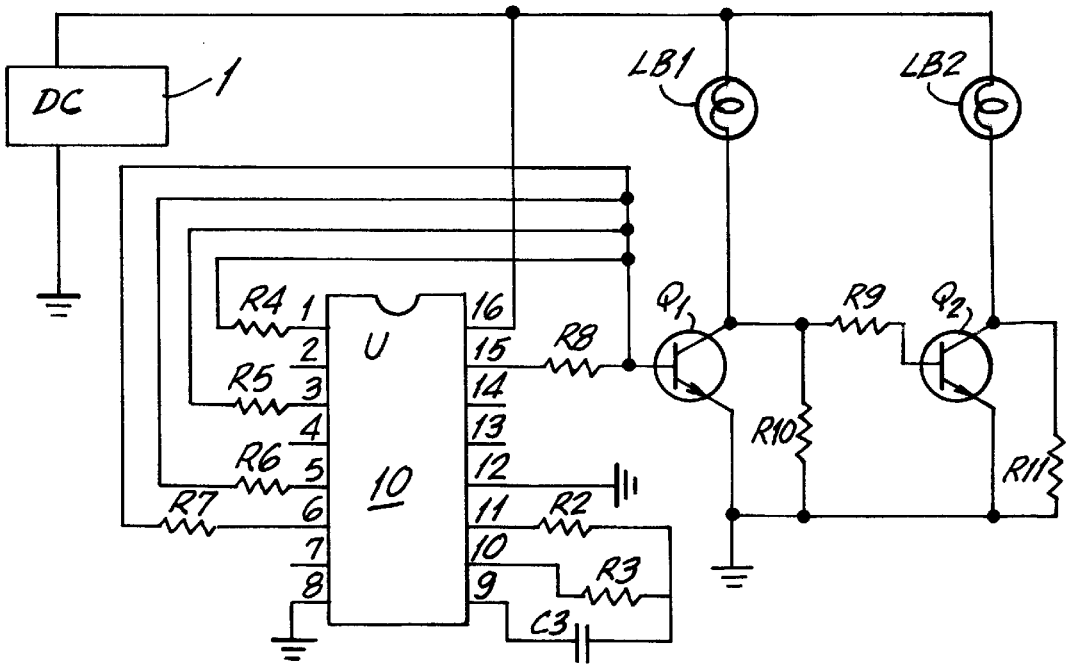

In FIG. 1, the candle flicker circuitry for bulbs LB1 and LB2 is shown with transistors Q1 and Q2 forming an inverter for the incoming power from DC power source 1 in the form of a rechargeable battery or other DC voltage source. Resistors R9 and R10 between the transistors form a switching element set by the resistor values. Resistors R11 and R10 serve to slow down the time interval for shut down of the light bulbs, thereby serving as a rush current prevention and to also maintain the respective filaments of the bulbs LB1 and LB2 in the pre-heated state so that the transition between lighting of the respective filaments is very gradual, with the formation of a bi-stable multi-vibrator. A single counter IC 10 creates the external driver circuitry. A portion of the IC 10 functions as a low stability oscillator and another portion serves as a counter, with the counter outputs being connected to resistors R2–6. The other ends of the resistors R2–6 are parallel and connected to the inverter. Random selection of filament lighting and intensity of the lighting through the respective resistors R2–6 is dependent on the counter. The parallel original values of the resistors determines the start of the inverter operation. Thereafter, depending on value selection (resistors and filaments), oscillator stability and the number of outputs used, there is created a variety of lighting appearances which will repeat only after several minutes, if the oscillator is stable, a time period for repetition not readily discernible by an onlooker. To further limit repeatability of the patterns, the components of resistors R2–6 and IC 10 are selected with tolerances of ±5% or more wherein the inherent variations in the actual operation of the elements further cause variations in patterns.

Figure 2:
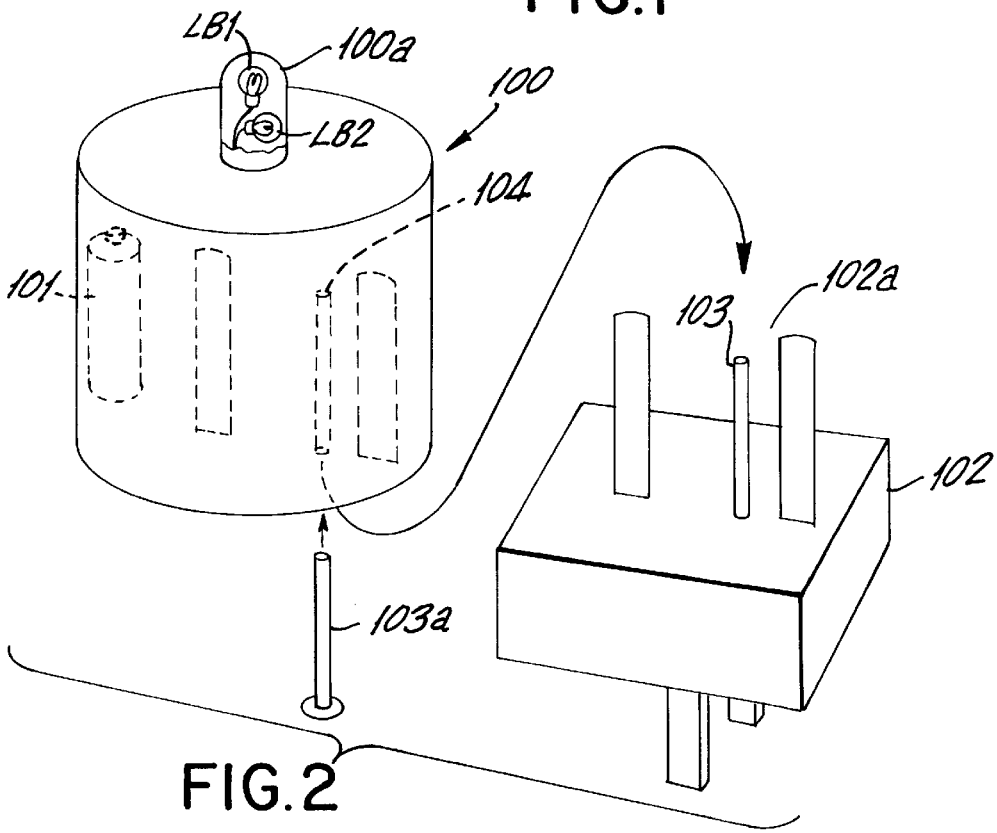

With reference to FIG. 2, a "candle" 100 of the present invention is shown in a flat cylindrical configuration with a translucent nipple section 100*a* (shown in cutaway) wherein light bulbs LB1 and LB2 are shown in close proximity but not in alignment wherein the respective filaments of the bulbs are set an angle relative to each other (in alignment, the bulbs would only show a continuous glow and not a flicker with motion). The circuitry of FIG. 1 is contained with the cylindrical housing as is battery 101, shown in phantom. Battery charger 102 accommodates the candle in a well 102*a* in which charging prong 103 is inserted into socket 104 of the candle. Prong 103 shuts off the lighting circuitry and provides an electrical connection between a recharging source and the battery 101. Separate prong element 103*a* provides a manual shutoff as long as it is inserted in socket 104 and remains there.

It is understood that the above description and drawings are only exemplary of the present invention and that changes in circuitry, components and configuration is possible without departing from the scope of the present invention as defined in the following claims.

What is claimed is:

1. A realistic wax candle emulation device comprising at least two miniature light bulbs with filaments therein, said bulbs being fixedly vertically arranged in a translucent housing wherein the filaments of the bulbs are offset from each other whereby they form an angle and wherein the light bulbs are electrically connected to a DC power source and random flicker circuitry means whereby the filaments are randomly and slowly lighted in a random pattern of filament lighting with varying lighting and intensity to emulate the illumination of a wax candle light.

2. The candle emulation device of claim 1 wherein the random flicker circuitry means comprises an inverter, with an external control and switch means, resistor means adapted to slow down light bulb shut down whereby the filaments are constantly pre-heated with a slow cool down, and whereby transition between the lighting of the light bulbs is very gradual, said device further comprises a single counter IC with a portion of the IC providing a low stability oscillator and another portion operating as a counter with outputs connected to respective first ends of at least two resistor elements wherein other ends of the resistors are parallel and connected to the inverter, said IC further comprising a random selector depending on the counter with the parallel original value of the resistor elements deciding the start of the inverter and then creating a variety of filament lighting selection and intensity patterns.

3. The candle emulation device of claim 2, wherein the resistor elements and IC have low tolerances in excess of ±5% whereby replication of said patterns is reduced thereby.

* * * * *